United States Patent [19]

English et al.

[11] 4,348,173

[45] Sep. 7, 1982

[54] SUBMINIATURE PHOTOFLASH LAMP WITH SPACED-APART, LIGHT-EMITTING PYROTECHNIC CHARGES

[75] Inventors: George J. English, Reading; John A. Scholz, Danvers, both of Mass.

[73] Assignee: GTE Products Corporation, Stamford, Conn.

[21] Appl. No.: 146,573

[22] Filed: May 5, 1980

[51] Int. Cl.[3] ..... F21K 5/02

[52] U.S. Cl. ..... 431/362; 431/358

[58] Field of Search ..... 431/357, 358, 362, 365; 362/11, 14, 15

[56] References Cited

U.S. PATENT DOCUMENTS 2,289,876 7/1942 De Margitta ..... 431/358

2,290,309 7/1942 Aquilla ..... 431/358

4,059,389 11/1977 Armstrong et al. ..... 431/362

4,204,834 5/1980 Fohl ..... 431/358 X

*Primary Examiner*—Edward G. Favors

*Attorney, Agent, or Firm*—Lawrence R. Fraley

[57] ABSTRACT

A subminiature photoflash lamp which includes a pair of pyrotechnic charges centrally disposed in a parallel, spaced relationship within the lamp's plastic, light-transmitting envelope. Each charge is supported on a respective one of the ends of the lamp's ignition wires and is of a disklike, planar configuration. The parallel spacing of the planar charges provides maximum light output from the lamp by permitting "cross-talking" between both charges during simultaneous ignition thereof. The ignition can be accomplished by the application of a firing pulse such as might be provided by a piezoelectric element.

12 Claims, 6 Drawing Figures

SUBMINIATURE PHOTOFLASH LAMP WITH SPACED-APART, LIGHT-EMITTING PYROTECHNIC CHARGES

DESCRIPTION

TECHNICAL FIELD

The present invention relates to photoflash lamps for use in the field of photography, and particularly to such lamps which are of the subminiature variety and adapted for being electrically activated. Even more particularly, the invention relates to photoflash lamps which utilize pyrotechnic light-emitting charges as the desired light source.

BACKGROUND

The present invention presents a new and unique concept in the production of subminiature photoflash lamps for use in photographic applications. The lamps of the instant invention are adapted for use in multilamp devices and articles which in turn may be positioned within or atop a camera. Examples of such cameras include those of the well known pocket variety as manufactured and sold by Eastman Kodak Company, Rochester, New York.

The subminiature photoflash lamp of the instant invention provides for the incorporation of a pair of light-emitting pyrotechnic charges centrally disposed within a light-transmitting envelope. The charges are electrically ignited by application of a suitable firing pulse (e.g., such as may be provided by a piezoelectric element typically associated with many of the above cameras) across the two electrical conductors which extend from the envelope and constitute part of the ignition means of the invention. As will be further defined, the invention can be readily produced and operated without the need for many of the components typically required in many of today's flashlamps. Specifically, the invention can be produced with greater ease and less cost than known lamps of the chemical variety. By the term chemical flashlamp is meant one having a glass envelope, a combustible material (.e.g., zirconium or hafnium shreds) within the envelope, a combustion-supporting atmosphere (e.g., oxygen) also within the envelope, and a pair of lead-in wires which project through the base of the glass envelope and include a quantity of primer material thereon for igniting the shredded combustible material. It will be understood from the following that the instant invention may be produced without the need for some of the above components, including a combustible material such as zirconium or hafnium shreds, a glass material for the flashlamp's envelope, and a combustion-supporting atmosphere such as oxygen which must be hermetically sealed within the envelope.

It is believed, therefore, that a subminiature photoflash lamp which is capable of being utilized with many of today's cameras and can be manufactured without the need for several of the aforementioned components heretofore required in chemical flashlamps will constitute a significant advancement in the art.

DISCLOSURE OF THE INVENTION

It is a primary object of the present invention to provide a new and unique subminiature photoflash lamp which possesses the features described above.

In accordance with a primary aspect of the present invention, there is provided a subminiature photoflash lamp which includes a light-transmitting envelope, a pair of spaced-apart pyrotechnic charges for emitting light through the envelope upon ignition thereof, each of the charges spacedly located from the internal walls of the envelope, ignition means including a pair of electrical conductors secured within the envelope and adapted for electrically igniting both pyrotechnic charges, and a pair of support means each adapted for supporting a respective one of the pyrotechnic charges within the envelope.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 1:
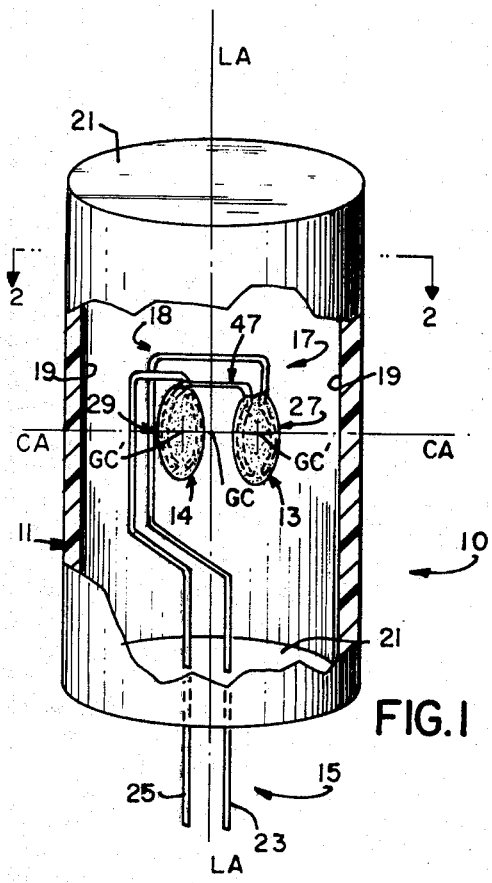
FIG. 1 is a front elevational, perspective view, in section, of a subminiature photoflash lamp in accordance with the preferred embodiment of the invention.

With particular reference to FIG. 1, there is shown a subminiature photoflash lamp 10 in accordance with the preferred embodiment of the invention. Lamp 10 comprises a light-transmitting envelope 11, first and second spaced-apart pyrotechnic charges 13 and 14, respectively, each located within the envelope at a preestablished distance from the internal surfaces thereof, ignition means 15 for providing electrical ignition of charges 13 and 14, and first and second support means 17 and 18, respectively, each for supporting a respective one of the pyrotechnic charges within envelope 11. By the term subminiature is meant a photoflash lamp wherein the internal volume of the lamp's envelope is equal to or less than about 0.30 cubic centimeters. Understandibly, such lamps are extremely small and incorporation of several of these members within a singular photoflash device assures that the finished device will be extremely small and compact.

Envelope 11 is preferably of a substantially tubular configuration having opposing longitudinal side walls 19 (in cross section), and opposing end walls 21. The envelope is manufactured from a light-transmitting plastic material (e.g., polypropylene or polyethylene), said material initially in the form of an elongated tube having an internal diameter of about 0.33 centimeters and a thickness of about 0.06 centimeters. The overall internal length of envelope 11, as illustrated in the finished configuration of FIG. 1, is approximately 2.00 centimeters.

Ignition means 15 comprises a pair of electrically conductive wires 23 and 25 which are secured (e.g., heat-sealed) within a first end 21 of the envelope and include an end portion which extends within the interior of the envelope as illustrated. Each extending end portion is electrically coupled to a respective one of the pyrotechnic charges 13 or 14. Each wire further includes an opposing end portion which projects from envelope 11 and is adapted for being electrically connected to the aforementioned piezoelectric element or similar power source for effecting ignition of lamp 10. A typical piezoelectric element provides a high voltage, low energy pulse approaching 5000 volts. The preferred conductive wiring as utilized in ignition means 17 is of copper material having an external diameter of about 0.025 centimeters. As will be understood from the following, each wire as used in the finished product preferably includes an insulative coating thereon with portions of the coating removed at the desired locations for effecting electrical contact.

The present invention represents a significant advancement over prior art flashlamps which utilize flash-producing charges in that it provides a means whereby the light output of the lamp is substantially increased over these earlier versions. It will also be understood from the following description that the unique arrangement of pyrotechnic charges of the instant invention further represents a significant improvement over the single charge lamp described in copending application under Ser. No. 146,574, entitled "Subminiature Photoflash Lamp Having Light-Emitting Pyrotechnic Charge" (Inventors: J. A. Scholz et al), filed May 5, 1980. As described in Ser. No. 146,574, a singular planar charge is centrally disposed within a plastic, light-transmitting envelope in a strategic relationship with regard to the internal walls of the envelope so as to permit maximum burning of the material. The present invention represents a substantial improvement to this arrangement by further providing a second charge spaced from the first in a predetermined orientation so as to permit "cross-talking" of the charges during the ignition thereof. Accordingly, it is possible to obtain greater outputs in the instant invention in comparison of those of Ser. No. 146,574. Further description of this unique arrangement will be provided below. It is also understood that the present invention represents an even greater improvement over prior art flashlamps utilizing flash-producing charges in that it strategically positions the lamp's charges away from the internal surfaces of the walls of the lamp's envelope such that maximum burning capacity of both charges and the aforementioned "cross-talking" is assured. To provide these features, lamp 10 further includes first and second support means 27 and 29, each utilized for supporting a respective one of the charges at the desired locations. The support means 27 and 29 may each be located on a respective one of the extending end portions of wires 23 or 25 or may form a part thereof. In a preferred embodiment of the invention, each support means comprises an extension of one of the conductive wires such that the conductive wire, having the aforedescribed insulative coating thereon, forms a substantially annular (coil) element (see FIG. 3). It is understood, however, that each support means 27 and 29 may include a separate, conductive annular (coil) member which is electrically conductive (e.g., metallic) and secured (e.g., soldered) to one of the ends of wires 23 and 25. As yet another embodiment, each support means can comprise an electrically insulative member (e.g., glass) which is positioned on a respective one of the ends of wires 23 or 25 with the wires strategically positioned therein or arranged thereabout such that the wire may be electrically coupled to the respective charge material.

Figure 2:
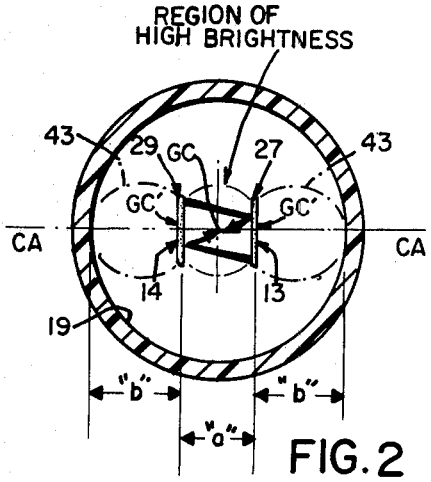
FIG. 2 is a plan view, in section, of the photoflash lamp of FIG. 1 as taken along the line 2—2 in FIG. 1, illustrating the preferred (parallel) spaced relationship between the two pyrotechnic charges of the invention.

With particular regard to FIG. 2, charges 13 and 14 are shown as being arranged in a parallel relationship so as to each transverse a respective one of the extending wires 23 or 25 to thereby form a substantially dislike, planar configuration. Being transverse, each dislike charge lies substantially between the respective portions of the wires although it is of course understood that the wires are covered by the charge material (see FIG. 3). These relationships constitute a significant feature of the invention in that they permit a minimum of contact between the conductive wiring which supports the charge and the charge material itself. Accordingly, the wires do not represent a substantial heat sink for the charge material during the burning thereof and thereby assure maximum output from each light-emitting charge. In the aforementioned arrangement, each charge will include a peripheral portion 41 thereabout (see FIG. 3). The respective extending end of the wire which forms the support means for each charge will thus occupy or physically contact the charge only at this peripheral portion.

As stated, the positioning of charges 13 and 14 within the envelope is deemed critical with regard to the instant invention in order to provide maximization of light output from the charges during simultaneous ignition thereof. In FIG. 2, the charges are arranged such that a midpoint therebetween is centrally disposed within the envelope, lying on the geometric center (GC) of the envelope. It is understood from the drawings that the envelope's geometric center GC also lies on the central axis (CA-CA) of the lamp which in turn is perpendicular to the longitudinal axis (LA-LA) of the lamp. More specifically, the central axis of the lamp is that axis passing through the geometric center of the lamp's envelope and lying substantially normal to the lamp's longitudinal axis. See also FIG. 1. It is preferred in this positioning in relationship that the geometric centers (GC') of each charge 13 and 14 also lie on central axis CA-CA.

As described, and as illustrated in FIG. 2, the thin planar charges 13 and 14 are oriented in a parallel relationship such that a midpoint therebetween lies at the geometric center of the envelope. When utilizing a tubular envelope having the aforementioned dimensions, the charges are spaced at a distance (dimension "a") of about 0.13 to about 0.25 centimeters apart. This distance is also preferred for the parallel arrangement depicted in FIG. 4. The illustrated parallel spacing permits the two charges 13 and 14 to establish multiple fires such that internal regions of each will burn with greater intensity and at increased temperatures over a singular charge embodiment, such as defined in Ser. No. 146,574. This "cross-talking" between the two charges, as illustrated by the directional arrows in FIG. 2, results in a region of high brightness between both charges. In addition to this central region, the configuration in FIG. 2 also produces on each opposing side of the charge a high intensity burning pattern 43. This pattern of particle burning, as illustrated, assures maximum ignition of the charge particles as a result of the strategic positioning between the respective charge and the spaced interior surfaces of the longitudinal walls 19. The embodiment of FIGS. 1 and 2 possessed a total light output within the range of about 100 lumen seconds to about 600 lumen seconds, or approximately twice that of copending application Ser. No. 146,574. Surprisingly, the output period was approximately one half of that of the singular disklike embodiment and ranged from about 1.5 to about 2.0 milliseconds (measured at half peak power). It was possible to even further increase peak power and pulse duration by the insertion of a Teflon liner (not shown) within envelope 11. Such a liner is preferably also tubular and has an external diameter approximately equal to that of the internal diameter of envelope 11. The thickness of such a liner can be equal to that of the envelope's side walls 19. The aforementioned increase occurs as a result of the liner's increased resistance to charring or discoloration as caused by the burning charge material in comparison to the polypropylene or polyethylene envelope, thus permitting greater light emission for an extended period. It is believed that this increased resistance is due to the greater thermal stability of the Teflon. That is, Teflon possesses a substantially greater resistance to heat without burning, charring, or similarly discoloring. Understandably, liners of other suitable materials could also be used for this purpose.

Each charge 13 and 14 possesses a thickness of only about 0.03 centimeters and is positioned at a preestablished distance (dimension "b") of from about 0.04 to about 0.10 centimeters from the internal surfaces of walls 19. As illustrated in FIG. 2, each of these dimensions from the respective charge is to a tangent passing perpendicularly through the central axis CA-CA of the lamp at an internal surface of the lamp's envelope and also parallel to the planes occupied by said charges. It is of course understood that the distances between other portions of each charge and the internal surfaces will vary accordingly but at no location will either charge physically engage the envelope's internal surfaces.

Figure 3:
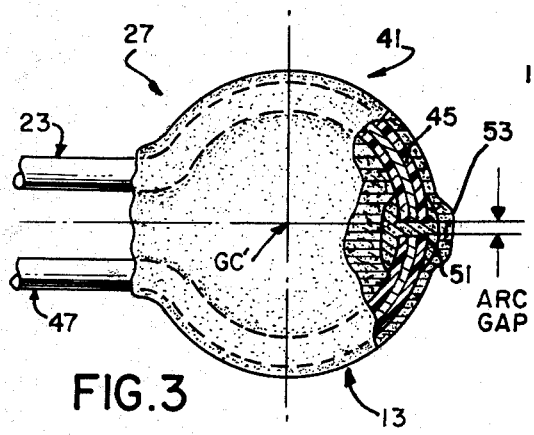
FIG. 3 is an enlarged partial plan view, partly in section, of a preferred embodiment of one of the invention's two pyrotechnic charges as positioned on one of the preferred support means of the invention.

With particular regard to FIG. 3, there is illustrated an enlarged view of one of the support means (27) having the respective pyrotechnic charge (13) located thereon. As shown, the support means is substantially formed as a part of the respective conductor 23, which in turn includes the aforedefined insulative coating (45) thereon. Ignition of charge 13 is enhanced by the provision of an arc gap (see FIG. 3) within conductor 23, thus resulting in the formation of a third conductor 47 which extends from support means 27 to the opposing support means in the manner illustrated in FIG. 1. Third conductor 47 thus serves to electrically connect each charge and thus assure simultaneous ignition of both charges upon application of the aforedefined pulse across conductors 23 and 25. It is also understood that a similar arc gap is provided between conductor 47 and the extending end of conductor 25 which serves to form the second support means of the invention. Conductor 47 also preferably includes an insulative coating thereon. Each of the arc gaps of the invention is approximately 0.025 centimeters wide and is bridged by the respective charge material transversely located on the corresponding support means. Application of the firing pulse across wires 23 and 25 results in the generation of a spark across each gap and subsequent, almost instantaneous ignition of the charge materials in physical contact therewith. The preferred minimal contact between the round, peripheral portion of charge 13 an the curvilinear (annular) support means formed by wires 23 and 47 is clearly illustrated in FIG. 3. As shown, the wires serve only to engage or physically contact the outer portions of the charge. It is understood that this positioning relationship is also preferred for charge 14.

The ignition means and dual support means of the invention are preferably manufactured from a singular piece of wire having the described insulation thereon. This wire is formed into the dual coil configuration depicted in FIG. 1 and the two arc gaps are thereafter provided therein (e.g., by a suitable notching tool). It is understood that the provision of these arc gaps results in the formation of the three separate wire conductors 23, 25, and 47 from the originally provided singular wire. The respective charge materials (to be described below) are thereafter positioned on the support means formed by the above configuration. When utilizing the above technique, a suitable holder (not shown) is used to maintain the prescribed alignment between the separated third conductor 47 and the remainin separate individual conductors 23 and 25. Each of these latter conductors is also preferably oriented within the same holder.

The preferred material for each of the charges 13 and 14 comprises a primer composition 51 (FIG. 3) and a fuel mixture 53 (also FIG. 3) located in physical contact with the primer. Accordingly, the primer 51 serves as the bridging member across the respective arc gaps and is encapsulated by the fuel mixture 53. The preferred primer composition for use in the instant invention may be selected from any of these presently utilized in the state of the art and adapted for being ignited by pulses typically provided from such sources as piezoelectric elements. One example of such a material is defined in in U.S. Pat. No. 4,059,388 (J. Shaffer), which is assigned to the assignee of the present invention. Approximately 0.50 milligrams of primer 51 is applied across each arc gap and about 5.00 milligrams of fuel mixture 53 thereafter applied for each charge. The preferred fuel mixture is a combination of zirconium and potassium perchlorate, with the zirconium comprising approximately 57% by weight of the total mixture. Accordingly, the potassium perchlorate comprised about 43% by weight of the mixture. The particle size of the zirconium is approximately 11 microns while that of the perchlorate is only 3 microns. Each fuel mixture 53 is dispersed in a nitrocellulose-acetone solution yielding a final percentage of 0.5% nitrocellulose in the dried fuel. Procedurally, each quantity of charge material is applied to the respective coil support means by initially dipping the notched or slotted coil within only the primer material, said primer in slurry form. The primer covers the respective arc gaps in the manner shown in FIG. 3. The dual coiled structure is then removed, the primer composition permitted to dry, and the entire structure emersed within the aforementioned fuel mixture, said mixture also in slurry form. The structure is then removed from the slurry mixture and the fuel permitted to dry. The aforedefined technique permits the charge material to transverse the respective coil support in the manner indicated. The structure is then oriented within an open end of the tubular envelope and the two conductors 23 and 25 heat sealed within one of the ends. The second, opposing end 20 of the envelope is then sealed.

Figure 4:
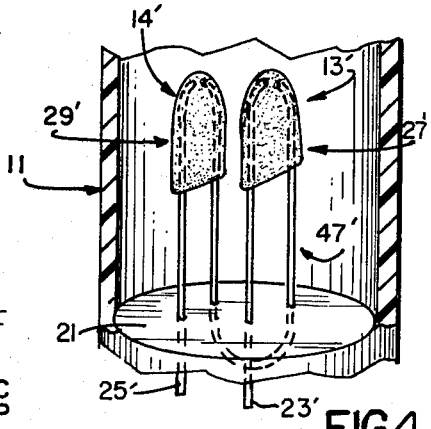
FIG. 4 is a partial front elevational view illustrating an alternate means of spacedly positioning the two pyrotechnic charges of the invention within the invention's envelope.

The embodiment of FIG. 4 represents still another version of positioning the two pyrotechnic charges (13' and 14') within a tubular envelope 11. The charges, arranged in a parallel arrangement, are spaced preferably at the same distance as charges 13 and 14 in FIG. 1

Accordingly, it is possible to achieve the aforedefined "cross-talking" between the two charges during simultaneous ignition thereof. In the embodment of FIG. 4, the interconnecting third conductor 47' is secured within the same end portion 21 of envelope 11 as the two conductors 23' and 25' which form the remainder of the invention's ignition means. As illustrated, a pair of arc gaps are provided such that each charge can be ignited in the same manner as that of the embodiment of FIG. 1. The resulting curvilinear support means 27' and 29' formed by the three conductors are each of a semicircular configuration, and are therefore not of the substantially coiled shape of the support means of FIG. 1. This arrangement, however, is understandably more stable than that of the embodiment of FIG. 1 as a result of the secured retention of all three conductors within the envelope's end portion.

Figure 5:
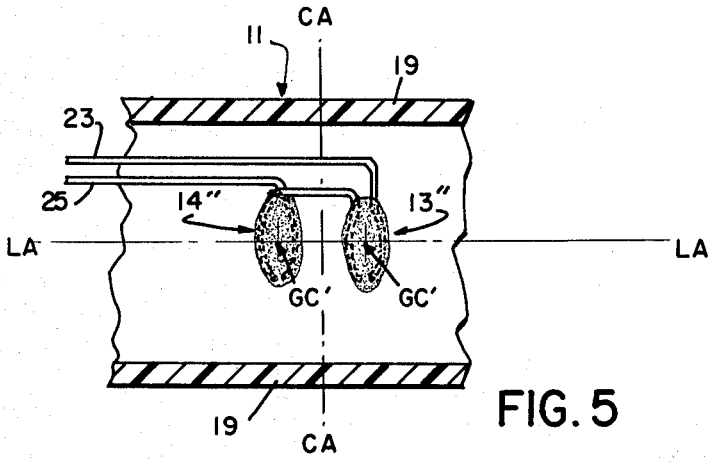
FIG. 5 is a partial front elevational view, in section, illustrating still another alternate means of orienting the spaced pyrotechnic charges of the invention.

With regard to FIG. 5, there is illustrated yet another version of positioning the planar charges (13'' and 14'') in a parallel, spaced relationship within the envelope 11. In this embodiment, the geometric centers (GC') of each chart is oriented along the longitudinal axis LA-LA of the envelope. The two conductors 22 and 25 of the invention's ignition means are understandably secured within one of the opposing ends (not shown) of envelope 11 in much the same manner as that depicted in FIG. 1. This orientation also proved to provide substantially the same outputs as described for that of FIG. 1, as did the arrangement of FIG. 4. As also shown in FIG. 5, the approximate midpoint of the parallel charges is located at the point of intersection between the envelope's longitudinal axis and central axis (CA-CA).

Figure 6:
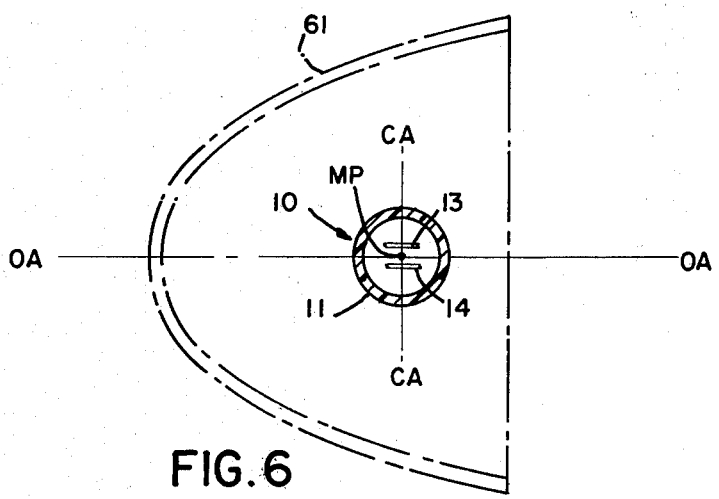
FIG. 6 is a reduced plan view illustrating the invention in a preferred orientation with respect to a reflector.

With regard to FIG. 6, the preferred positioning relationship between lamp 10 (FIG. 1) and a reflector 61 (shown in phantom), as might be typically provided within many of today's cameras, is shown. In this arrangement, the midpoint between the parallel charges 13 and 15 (illustrated as MP) will preferably be located at the focal point of reflector 61 and also along the reflector's optical axis OA-OA. Accordingly, the planes occupied by the disklike charges 13 and 14 will lie substantially parallel to axis OA-OA. This arrangement assures maximum forward emission of the light generated by both charges upon ignition of lamp 10. It is understood, of course that lamp 10 could be arranged in various alternative orientations and adequate output still achieved. For example, it is also possible to arrange the lamp such that the lamp's axis CA-CA is coaxially aligned with optical axis OA-OA.

Thus there has been shown and described a new and unique photoflash lamp adapted for use with many of today's higher speed (e.g., ASA 400) films. The invention as defined provides the aforementioned outputs while still assuring miniaturization of the lamp's capsule or envelope component. As has been described, the invention is fully capable of being successfully operated without the need for the aforementioned components associated with known chemical flashlamps such as hafnium or zirconium shreds, a glass material for the envelope, or a combustion-supporting atmosphere to permit successful ignition of said shredded material. As has also been described, the invention represents an improvement over the pyrotechnic charge lamp of corresponding application Ser. No. 146,574 by providing substantially improved outputs and reduced output times.

While there have been shown and described what are at present considered the preferred embodiments of the invention, it will be obvious to those skilled in the art that various changes and modifications may be made therein without departing from the scope of the invention as defined by the appended claims.

What is claimed is:

1. A subminiature photoflash lamp comprising:

a light-transmitting envelope;

first and second spaced-apart pyrotechnic charges for emitting light through said envelope upon ignition thereof, each of said charges comprising a primer composition and a fuel mixture and located within said envelope at a preestablished distance from the internal surfaces of the walls of said envelope, said charges being positioned within said envelope relative to each other such that each of said charges assists in the ignition of the other to create a region of the high brightness therebetween;

ignition means for electrically igniting said first and second pyrotechnic charges in a substantially simultaneous manner, said ignition means including first and second electrical conductors secured within said envelope, each of said conductors having an end portion extending within said envelope, said extending end portions electrically coupled to said first and second pyrotechnic charges; and first and second support means for supporting said first and second pyrotechnic charges, respectively, within said envelope at said preestablished distances from said internal surfaces, said first support means located on the extending end portion of said first electrical conductor or forming a part thereof, said second support means located on the extending end portions of said second conductor or forming a part thereof.

2. The photoflash lamp according to claim 1 wherein said light transmitting envelope is plastic and of a substantially tubular configuration.

3. The photoflash lamp according to claim 2 wherein said envelope includes a sealed end portion, said first and second electrical conductors secured within said sealed end portion.

4. The photoflash lamp according to claim 1 wherein said first and second pyrotechnic charges are substantially centrally positioned within said light-transmitting envelope.

5. The photoflash lamp according to claim 1 wherein each of said pyrotechnic charges is substantially planar, said charges oriented within said envelope in a parallel relationship.

6. The photoflash lamp according to claim 1 wherein each of said support means is electrically conductive and of a substantially curvilinear configuration, said first pyrotechnic charge transversing said curvilinear first support means, said second pyrotechnic charge transversing said curvilinear second support means.

7. The photoflash lamp according to claim 6 wherein each of said pyrotechnic charges is of a planar, disklike configuration including a round peripheral portion thereabout, said charges oriented within said envelope in a parallel relationship, said first and second curvilinear support means only contacting said peripheral portions of said first and second charges, respectively.

8. The photoflash lamp according to claim 6 wherein said curvilinear first support means includes a slot therein of sufficient width to define an arc gap, a portion of said pyrotechnic charge bridging said arc gap.

9. The photoflash lamp according to claim 8 wherein said curvilinear second support means includes a slot therein of sufficient width to define an arc gap, a portion of said pyrotechnic charge bridging said gap, said ignition means further including a third electrical conductor electrically connecting said first and second pyrotechnic charges.

10. The photoflash lamp according to claim 9 wherein each of said primer compositions of said first and second charges bridges a respective one of said arc gaps within said first and second curvilinear support means, respectively, said fuel mixtures of said first and second charges located in physical contact with said primer compositions of said first and second charges respectively.

11. The photoflash lamp according to claim 1 wherein each of said electrical conductors comprises a metallic wire, said metallic wire of said first conductor physically contacting said first pyrotechnic charge, said metallic wire of said second conductor physically contacting said second pyrotechnic charge.

12. The photoflash lamp according to claim 11 wherein said ignition means further includes a third metallic wire located within said envelope in physical contact with said first and second pyrotechnic charges.

* * * * *